US007828347B2

(12) United States Patent
Eller et al.

(10) Patent No.: US 7,828,347 B2
(45) Date of Patent: Nov. 9, 2010

(54) FIRE PLATE FOR A BORED IN LOCK ASSEMBLY

(75) Inventors: Darren C. Eller, East Lyme, CT (US); Ryan Piantek, Middletown, CT (US); Michael Ronzello, Berlin, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 11/734,959

(22) Filed: Apr. 13, 2007

(65) Prior Publication Data

US 2008/0251264 A1 Oct. 16, 2008

(51) Int. Cl.
*E05B 9/00* (2006.01)
*E05B 65/10* (2006.01)

(52) U.S. Cl. ..... 292/337; 292/92; 292/357; 292/DIG. 54

(58) Field of Classification Search ..... 292/92, 292/337, 357, DIG. 54; 70/141, 416, 417, 70/447–452, DIG. 3, DIG. 43
See application file for complete search history.

(56) References Cited

U.S. PATENT DOCUMENTS

| | | | | | |
|---|---|---|---|---|---|
| 180,894 | A * | 8/1876 | Leach | 70/448 |
| 1,661,454 | A * | 3/1928 | Wilson | 70/448 |
| 1,701,994 | A * | 2/1929 | Wilson | 292/169.18 |
| 1,876,079 | A * | 9/1932 | Schlage | 292/169.22 |
| 1,981,289 | A * | 11/1934 | Schlage | 292/337 |
| 1,991,031 | A * | 2/1935 | Schlage | 70/476 |
| 2,538,688 | A * | 1/1951 | Heyer | 292/337 |
| 2,779,186 | A * | 1/1957 | Grevengoed et al. | 70/451 |
| 2,785,565 | A * | 3/1957 | Schlage | 70/451 |
| 2,795,948 | A * | 6/1957 | Rayburn | 292/169.18 |
| 3,136,572 | A * | 6/1964 | Lytle | 292/336.3 |
| 4,109,498 | A * | 8/1978 | Dietrich | 70/449 |
| 4,141,234 | A * | 2/1979 | Hoos | 70/350 |
| 4,407,537 | A * | 10/1983 | Ames | 292/337 |
| 4,561,212 | A * | 12/1985 | Ullman, Jr. | 49/503 |
| 4,854,620 | A * | 8/1989 | Dunphy et al. | 292/337 |
| 5,718,468 | A * | 2/1998 | Qureshi et al. | 292/347 |
| 6,318,026 | B1 * | 11/2001 | Ayres et al. | 49/503 |
| 2005/0284030 | A1 * | 12/2005 | Autovino et al. | 52/1 |

* cited by examiner

*Primary Examiner*—Carlos Lugo
*Assistant Examiner*—Alyson M Merlino
(74) *Attorney, Agent, or Firm*—DeLio & Peterson, LLC

(57) ABSTRACT

A fire plate for receiving a bored in lock assembly and preventing passage of fire through a lock opening bored perpendicularly through a fire door. The fire plate is particularly adapted for use with integrated lock and latch assemblies that are designed for installation through a latch opening bored from an edge of the door into the lock opening. The latch opening has a diameter less than the lock opening and the fire plate blocks the space above and below the lock assembly in the lock opening to prevent the passage of smoke and fire through the lock opening. The fire plate includes two fire stop barriers that may be formed by bending from a sheet of spring steel and which preferably snap into engagement with the lock assembly as it is inserted from the latch opening into the lock opening.

22 Claims, 2 Drawing Sheets

FIRE PLATE FOR A BORED IN LOCK ASSEMBLY

BACKGROUND OF THE INVENTION

1. Field of the Invention

This invention relates to devices for preventing the spread of fire through a lock opening bored in a fire door. More specifically, this invention relates to preventing the penetration of fire through the lock opening when a lock assembly installed in the lock opening does not completely fill the lock opening or is made of a material that cannot withstand the intense heat of a fire.

2. Description of Related Art

Fire doors act to isolate a fire and prevent the spread of fire through the door opening. In addition to preventing the spread of flames through the door opening, fire doors act to restrict the flow of smoke and noxious gases away from the fire and limit the flow of air that feeds the fire. By preventing the flow of smoke away from the fire area, people in the unaffected areas are given more time to escape and smoke damage to goods is limited. By restricting the flow of air, fire growth is slowed. However, to be effective, a fire door must keep the door opening well sealed even when exposed to the high temperatures produced during a fire.

Although a fire door serves an important function in fires, it also must be useful in daily operations, and must be provided with handles, a latch and/or a lock. A common type of latching and/or lock mechanism used in doors of all types, including fire doors, is referred to herein as a "bored in lock assembly." The term "bored in" refers to the openings bored into the door which allow installation of the lock assembly and which provide a connection to handles on opposite faces of the door.

A door is conventionally prepared for the installation of a bored in lock assembly by boring two perpendicular openings in the door. The first opening will be referred to herein as the "lock opening" and extends completely through the door. This opening is of particular concern in a fire door as it passes directly through the fire barrier provided by the fire door. The second opening will be referred to herein as the "latch opening." This opening is generally smaller in diameter than the lock opening and extends from the edge of the door perpendicularly into the lock opening.

One type of bored in lock assembly includes a lock mechanism installed in the lock opening and a separate latch mechanism installed through the latch opening and connected to the lock mechanism. Handles are installed that connect to the lock mechanism and project out of the lock opening. The handles drive the lock mechanism and the lock mechanism drives a latchbolt in the latch mechanism. The latchbolt engages and disengages a strike in the door frame. A rose or escutcheon surrounds the base of each handle and covers the lock opening.

In the two-piece lock assembly described above, with separate lock and latch mechanisms, the lock mechanism is usually cylindrical in shape and may completely fill the cylindrical bored lock opening that it fits into. Provided that the lock mechanism is made of a fire resistant material, such as steel, the lock mechanism itself will act to prevent the spread of fire through the lock opening. However, if the lock mechanism is not made of a material having sufficient fire resistance, or if it is not sufficiently large to fill the lock opening, there is a risk that a fire will penetrate the lock opening.

In an alternative to the two-piece lock design described above, the latch mechanism and lock mechanism are integrated in a single integrated assembly that is installed in the fire door through the latch opening. Because this type of integrated latch and lock mechanism is inserted through the smaller latch opening, it cannot completely fill the lock opening. The integrated latch and lock mechanism extends into the lock opening sufficiently far to allow handles to be connected, but there will be spaces or gaps above and below the lock assembly.

Locking functionality in this type of integrated lock design may be controlled through a button on the handle or through a control that extends through a rose plate, adjacent to the base of the handle. In some cases, for interior non-locking fire doors, the lock functionality may be omitted and the mechanism will provide only a latching function.

Because the integrated latch/lock assembly in this type of lock mechanism does not completely fill the lock opening, a gap is formed around the lock in the lock opening through which fire, smoke or air may pass. It is important that this gap be sealed for proper fire resistance when an integrated latch/lock assembly is installed in a fire door.

A related problem is that some bored in lock assembly designs are advantageously made of materials having a relatively low fire resistance, such as molded plastics, composite materials and metals with a low melting point, such as brass or aluminum. As a result, the lock assembly itself, or the rose plate and/or the handle may fail in the fire by melting, warping or deforming. Each of these potential failures presents a risk that a gap will open up in the lock opening around the lock assembly, creating a passage in the lock opening that breaches the fire door and through which a fire may pass.

Fire certification testing requires that fire doors and the lock hardware installed therein provide a predetermined minimum fire resistance by keeping all openings in the fire door sealed when the door and installed hardware are exposed to specified fire temperatures for a specified time. Many types of integrated lock and latch mechanisms (which have gaps around the integrated mechanism in the lock opening) and many lock mechanisms made of materials with lower fire resistance (which may melt or distort) cannot be installed in fire doors because they cannot meet fire certification requirements.

SUMMARY OF THE INVENTION

Bearing in mind the problems and deficiencies of the prior art, it is therefore an object of the present invention to provide a fire plate for preventing the passage of fire through a lock opening which can be installed on an integrated latch and lock bored in lock assembly. The fire plate acts to seal gaps in the lock opening around the lock mechanism through which a fire might pass.

Another object of the present invention is to provide a fire plate for preventing the passage of fire through a lock opening which allows bored in lock assemblies to be made of materials having a fire resistance less than a predetermined minimum fire resistance. The fire plate prevents the passage of fire through the lock opening even if the lock assembly is made of a material that may melt or warp when exposed to the heat of a fire.

Yet another object of the invention is to provide a fire plate that is easily installed and is inexpensively produced. Still other objects and advantages of the invention will in part be obvious and will in part be apparent from the specification.

The above and other objects, which will be apparent to those skilled in the art, are achieved in the present invention which is directed to a fire plate for receiving a bored in lock assembly and preventing passage of fire through a lock opening bored through a door. The fire plate includes a first fire stop barrier formed from fire resistant sheet material, a second fire stop barrier and a fire stop connector connecting the first and second fire stop barriers.

The first fire stop barrier has a first curved perimetrical edge corresponding in curvature to a curved inner surface of the lock opening and a first opening for allowing connection between the bored in lock assembly and a first handle. The second fire stop barrier includes a second curved perimetrical edge corresponding in curvature to the curved inner surface of the lock opening and second opening for allowing connection between the bored in lock assembly and a second handle. The fire stop connector connects the first fire stop barrier to the second fire stop barrier and holds the first and second fire stop barriers in an opposed relationship to receive the bored in lock assembly therebetween.

The fire stop connector is positioned away from the latch opening to allow the bored in lock assembly to operate a latchbolt in the latch opening. The first and second fire stop barriers are cooperatively shaped and positioned relative to the bored in lock assembly and to the lock opening to prevent the passage of fire through the lock opening around the bored in lock assembly.

Although the fire stop connector and the fire stop barriers of this invention may be constructed from separate components that are riveted, welded or otherwise fastened together, in the preferred embodiment, the fire plate is constructed from a single sheet of fire resistant sheet material, such as spring steel. A blank is first cut from the sheet material by stamping or other process and the first and second fire stop barriers and the fire stop connector are then produced by bending the blank. The fire resistant sheet material preferably also produces a spring action, which allows the first and second opposed fire stop barriers to grip the bored in lock assembly on opposite sides.

In one aspect of the invention, the first and second fire stop barriers have corresponding opposed first and second lips that are bent outwards. The outwardly bent lips act to guide the bored in lock assembly between the fire stop barriers and to spread the barrier pieces apart as the bored in lock assembly is inserted between them. In the most highly preferred embodiment, the fire plate and the bored in lock assembly are cooperatively shaped so that they engage each other when the lock assembly is fully and correctly inserted into the fire plate. The spring action causes the fire plate to snap into locking engagement with the bored in lock assembly when the lock reaches the correct position as it is inserted between the fire stop barriers.

In another aspect of the invention, the first fire stop barrier is provided with an elongated opening that extends to an edge of the first fire stop barrier. The elongated opening engages the lock assembly as it is inserted from the latch opening into the lock opening. The elongated opening prevents the fire plate from rotating relative to the lock assembly and acts to hold the two items in the desired relationship.

In the most highly preferred embodiment, the first fire stop barrier is upwardly offset relative to the second fire stop barrier. The first curved perimetrical edge of the first fire stop barrier contacts the upper inner surface of the lock opening and the second curved perimetrical edge of the second fire stop barrier contacts the lower inner surface of the lock opening.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-4 of the drawings in which like reference numbers refer to like features of the invention.

Figure 1:
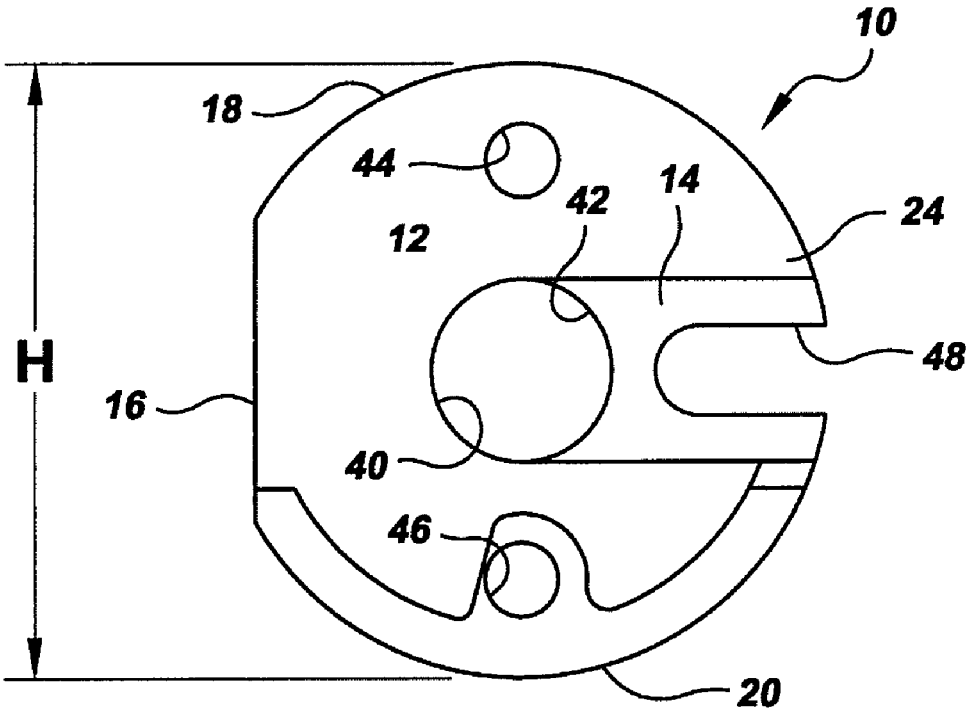
FIG. 1 is a front elevational view of a preferred embodiment of a fire plate according to the present invention.
Figure 2:
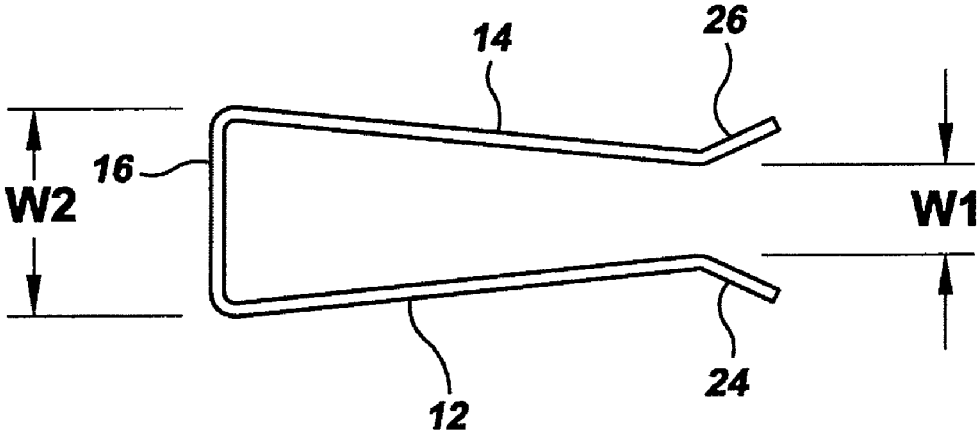
FIG. 2 is a top plan view of the fire plate shown in FIG. 1.
Figure 3:
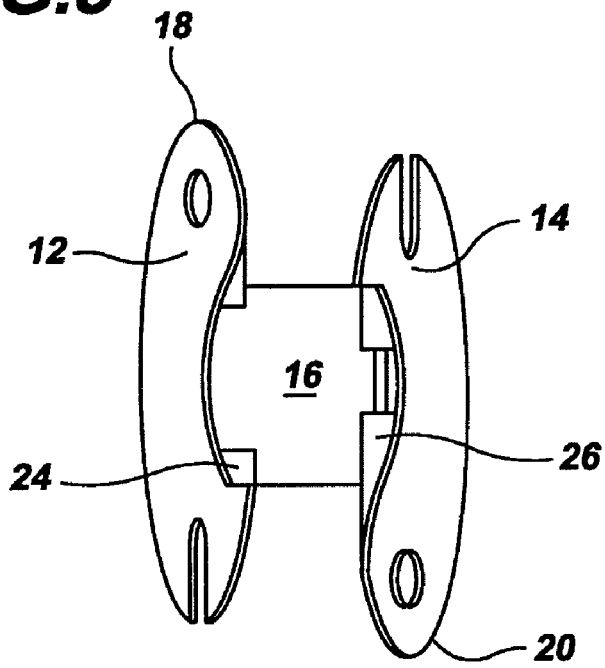
FIG. 3 is a right side elevational view of the fire plate shown in FIG. 1.

Referring to FIGS. 1-3 a fire plate 10 according to the present invention includes a first fire stop barrier 12 connected to a second fire stop barrier 14 by a fire stop connector 16. The first fire stop barrier 12 includes a first curved perimetrical edge 18 along the upper edge of the fire stop barrier 12. The second fire stop barrier 14 includes a second curved perimetrical edge 20 along the lower edge of the second fire stop barrier 14.

Figure 4:
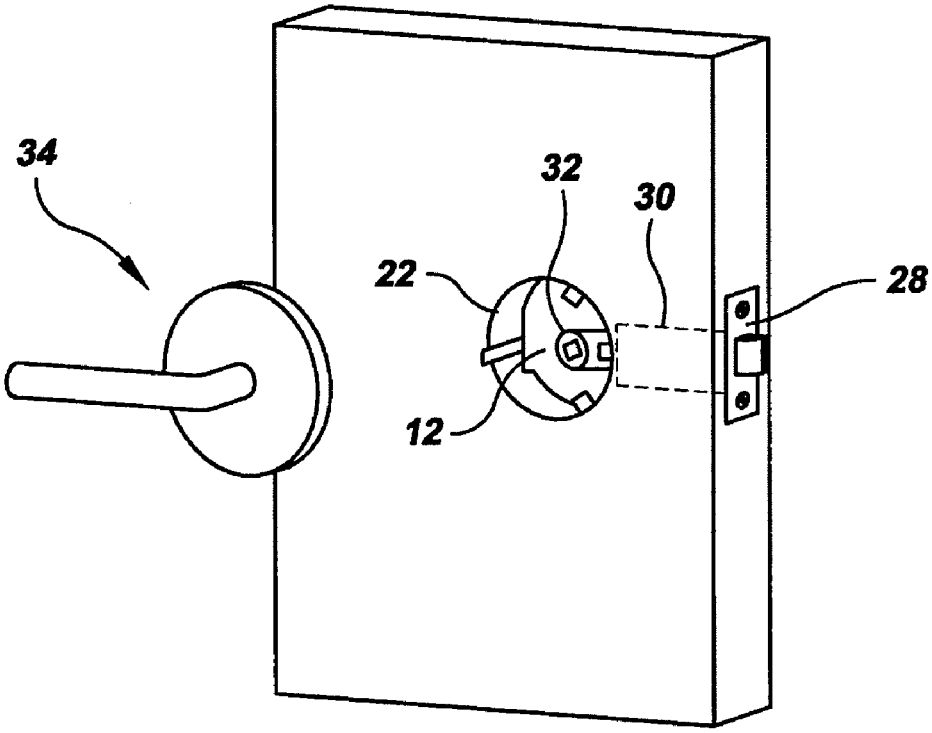
FIG. 4 is a perspective view showing a fire plate according to the present invention installed in a lock opening of a door. A bored in lock assembly having an integrated lock and latch mechanism is shown installed in the latch opening and projecting into the lock opening of the fire door. A handle with a rose plate is also shown nearby, ready for installation and connection to the bored in lock assembly.

The radius of curvature of the first and second curved perimetrical edges 18, 20 matches the radius of curvature of the lock opening 22 as can be seen in FIG. 4. Referring to FIG. 3, in the preferred embodiment, the first fire stop barrier 12 is upwardly offset relative to the second fire stop barrier 14 so that the first curved perimetrical edge 18 contacts and seals against the upper inner surface of the lock opening 22 while the second curved perimetrical edge 20 contacts and seals against the lower inner surface of the lock opening 22. The diameter "H" of the fire plate as seen in FIG. 1 (as measured from the first curved perimetrical edge 18 to the second curved perimetrical edge 20) equals the diameter of the lock opening 22 bored through the fire door.

Referring to FIG. 2, the first and second fire stop barriers 12, 14 have corresponding opposed first and second outwardly bent lips 24 and 26. The first curved perimetrical edge 18 extends from the first outwardly bent lip 24 to an upper corner of the fire stop connector portion 16. The second curved perimetrical edge 20 extends from the second outwardly bent lip to a lower corner of the fire stop connector portion 16.

Although the fire plate may be constructed of separate elements forming the fire stop barriers, in the preferred embodiment, the fire plate is formed from a single piece of fire resistant spring steel. The connector 16, the first and second fire barriers 12, 14 and the first and second outwardly bent lips 24, 26 are all formed by bending a blank that is initially flat. The blank may be formed from the sheet material by stamping, cutting or other known methods. The spring steel used in the preferred design provides a spring action between the opposed fire stop barriers 12, 14.

As may be seen in FIG. 2, the fire stop barriers 12, 14 are held in a spaced apart relationship by the connector 16. Prior to installation the connector 16 holds the fire stop barriers so that they are bent slightly inward, having a separation of distance "W2" near the connector portion 16 and a separation distance of "W1" near the outwardly bent lips 24, 26.

The outward bends of the lips 24, 26 act to spread apart the fire stop barriers 12, 14 and guide a bored in lock assembly 28 into the region between them. The spring action of the preferred spring steel material causes the opposed fire stop barriers 12, 14 to grip the lock mechanism between them. When used with an integrated lock/latch assembly, the fire stop is first positioned in the lock opening 22, and the integrated lock assembly 28, as shown in FIG. 4, is inserted through the latch opening 30 and into the lock opening 22.

The bored in lock assembly 28 includes a spindle receiver 32 adapted to receive a conventional handle spindle with a square cross section extending from the handle and rose assembly 34. The spindle receiver 32 has a cylindrical outer surface that projects slightly outward from the surface of the lock assembly 28. The outer diameter of the spindle receiver 32 approximately matches the inner diameter of the handle opening 40 in the first fire barrier 12.

As the bored in lock assembly 28 enters the lock opening 22 from the latch opening 30, it spreads open the lips 24, 26 and separates the first and second fire barriers 12, 14. The first and second fire barriers 12, 14 are preferably provided with one or more openings that cooperate with and engage corresponding portions of the bored in lock assembly. Referring to the preferred embodiment as seen in FIG. 1, the handle opening 40 in the first fire barrier 12 engages the bored in lock assembly at the spindle receiver 32. A second handle opening 42 in the second fire barrier 14 snaps into engagement with the opposite side of the bored in lock assembly 28.

When the lock assembly 28 is inserted through the latch opening and into the lock opening such that it is fully engaged with the bored in lock assembly, the fire stop barriers 12, 14 become substantially parallel to each other on opposite sides of the lock assembly. The spring action of the connector 16 holds the opposed fire stop barriers 12, 14 against the lock assembly and causes the fire stop barriers to snap into engagement with the lock assembly.

The first and second fire stop barriers 12, 14 include openings 44 and 46 that allow bolts to pass through the fire stop and permit assembly of the handles and lock assembly. The handle opening 40 in the first fire barrier 12 extends to the edge of the barrier through the outwardly bent lip 24. This elongated opening preferably engages corresponding structure on the outer surface of the bored in lock assembly to prevent rotation of the fire stop relative to the lock assembly. The second fire stop barrier 14 is also provided with an elongated opening 48 that may engage corresponding structure on the opposite side of the lock assembly.

The bottom edge of the first fire barrier 12 and the upper edge of the second fire barrier 14 are shaped to cooperate with the handles when installed. Those of skill in this art will recognize that the various openings and the edges of the first and second fire barriers 12, 14 may be shaped to mate with the lock assembly and with the handle assemblies. The specific shape of the perimeter of the fire stop, and the shape of the openings formed therein may be selected to provide the snap-in engagement function, the anti-rotation function and/or to provide desired interconnections between the lock and the handles, while still forming a fire and smoke barrier around the lock assembly that seals with the lock opening in the fire door.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A fire plate and door assembly, the door having a lock opening bored from a first face of the door perpendicularly through the door to a second face of the door, the lock opening having a curved inner surface and defining a lock opening axis and the door having a latch opening bored from an edge of the door into the lock opening perpendicular to the lock opening axis, the fire plate capable of receiving a bored-in-lock assembly and preventing passage of fire through the lock opening, the fire plate comprising:

a first fire stop barrier formed from a fire resistant sheet material, the fire resistant sheet material defining a substantially planar surface of the first fire stop barrier, the first fire stop barrier being shaped to fit within the lock opening with the substantially planar surface of the first fire stop barrier being oriented substantially parallel to the first and second face surfaces of the door and substantially perpendicular to the lock opening axis, the substantially planar surface of the first fire stop barrier having a first curved perimetrical edge corresponding in curvature to and contacting an upper part of the curved inner surface of the lock opening, the fire resistant sheet material forming the first fire stop barrier extending across the lock opening to resist passage of fire through the lock opening, the first fire stop barrier having a first opening for allowing connection between the bored-in-lock assembly and a first handle;

a second fire stop barrier formed from a fire resistant sheet material, the fire resistant sheet material of the second fire stop barrier defining a substantially planar surface of the second fire stop barrier, the second fire stop barrier being shaped to fit within the lock opening with the substantially planar surface of the second fire stop barrier being oriented substantially parallel to the first and second face surfaces of the door and substantially perpendicular to the lock opening axis, the substantially planar surface of the second fire stop barrier having a second curved perimetrical edge corresponding in curvature to and contacting a lower part of the curved inner surface of the lock opening, the second fire stop barrier having a second opening for allowing connection between the bored-in-lock assembly and a second handle; and a fire stop connector connecting the first and second fire stop barriers and holding the first and second fire stop barriers in an opposed spaced relationship to receive the bored-in-lock assembly therebetween;

the fire stop connector being positioned away from the latch opening to allow the bored-in-lock assembly to operate a latchbolt in the latch opening, and the first and second fire stop barriers being cooperatively shaped and positioned relative to the bored-in-lock assembly and to the lock opening to prevent the passage of fire in the direction of the lock opening axis around the bored-in-lock assembly.

2. The fire plate and door assembly according to claim 1 wherein the first and second fire stop barriers and the fire stop connector are integrally formed from a single sheet of the fire resistant sheet material, the first and second fire stop barriers being connected to the fire stop connector at bends formed in the fire resistant sheet material.

3. The fire plate and door assembly according to claim 2 wherein the fire resistant sheet material has spring properties providing an inwardly directed spring action with respect to and between the first and second fire stop barriers which grips the bored-in-lock assembly between the opposed first and second fire stop barriers.

4. The fire plate and door assembly according to claim 1 wherein the first and second fire stop barriers have corresponding opposed first and second outwardly bent lips, the first and second outwardly bent lips acting to spread apart the opposed first and second fire stop barriers and receive the bored-in-lock assembly between the opposed first and second fire stop barriers.

5. The fire plate and door assembly according to claim 4 wherein:

the first outwardly bent lip is at an opposite edge of the first fire stop barrier from the fire stop connector and the first curved perimetrical edge connects the first outwardly bent lip to the fire stop connector; and the second outwardly bent lip is at an opposite edge of the second fire stop barrier from the fire stop connector and the second curved perimetrical edge connects the second outwardly bent lip to the fire stop connector.

6. The fire plate and door assembly according to claim 3 wherein the inwardly directed spring action causes the fire plate to snap into engagement with the bored-in-lock assembly when the bored in lock assembly is inserted between the first and second fire stop barriers.

7. The fire plate and door assembly according to claim 1 wherein the fire plate has a spring action between the first and second fire stop barriers which grips the bored-in-lock assembly between the opposed first and second fire stop barriers.

8. The fire plate and door assembly according to claim 7 wherein the fire plate spring action between the first and second fire stop barriers causes the fire plate to snap into engagement with the bored-in-lock assembly.

9. The fire plate and door assembly according to claim 1 wherein the fire plate engages the bored-in-lock assembly when the bored in lock assembly is inserted from the latch opening into the lock opening.

10. The fire plate and door assembly according to claim 1 wherein the fire plate has a spring action between the first and second fire stop barriers which grips the bored-in-lock assembly between the opposed first and second fire stop barriers when the bored-in-lock assembly is inserted from the latch opening into the lock opening;

the first and second fire stop barriers have corresponding opposed first and second outwardly bent lips located on opposite sides of the latch opening when the fire plate is in the lock opening; and the first and second outwardly bent lips act to spread apart the first and second fire stop barriers and receive the bored-in-lock assembly between the opposed first and second fire stop barriers wherein the spring action causes the fire plate to snap into engagement with the bored-in-lock assembly when the bored-in-lock assembly is inserted between the first and second fire stop barriers from the latch opening into the lock opening.

11. The fire plate and door assembly according to claim 1 wherein the first opening in the first fire stop barrier is elongated and extends to an edge of the first fire stop barrier, the elongated first opening engaging the bored-in-lock assembly when the bored-in-lock assembly is inserted from the latch opening into the lock opening to prevent rotation of the fire plate relative to the bored-in-lock assembly.

12. The fire plate according to claim 1 wherein the first fire stop barrier is upwardly offset relative to the second fire stop barrier, and wherein only the first curved perimetrical edge of the first fire stop barrier contacts the upper part of the inner surface of the lock opening and only the second curved perimetrical edge of the second fire stop barrier contacts the lower part of the inner surface of the lock opening.

13. A fire plate for a bored in lock assembly installable into a door having a lock opening bored from a first face of the door perpendicularly through the door to a second face of the door, the lock opening defining a lock opening axis and the door having a latch opening bored from an edge of the door into the lock opening perpendicular to the lock opening axis, the bored-in-lock assembly being installable by inserting the bored-in-lock assembly through the latch opening, the fire plate being formed by bending from a single sheet of fire resistant spring steel and comprising:

a first fire stop barrier formed from the sheet of fire resistant spring steel, the fire resistant sheet material defining a substantially planar surface of the first fire stop barrier, the first fire stop barrier being shaped to fit within the lock opening with the substantially planar surface of the first fire stop barrier being oriented substantially parallel to the first and second face surfaces of the door and substantially perpendicular to the lock opening axis, the first fire stop barrier having a first outwardly bent lip along one edge;

a fire stop connector connected to the first fire stop barrier and formed by bending from the sheet of fire resistant spring steel, the fire stop connector being bent away from the first fire stop barrier at an opposite edge from the edge of the first fire stop barrier having the first outwardly bent lip; and a second fire stop barrier connected to the fire stop connector and formed by bending from the sheet of fire resistant spring steel, the second fire stop barrier having a substantially planar surface, the second fire stop barrier being shaped to fit within the lock opening with the substantially planar surface of the second fire stop barrier being oriented substantially parallel to the first and second face surfaces of the door and substantially perpendicular to the lock opening axis, the second fire stop barrier having a second outwardly bent lip along an opposite edge from the fire stop connector;

the first and second fire stop barriers being in a substantially opposed relationship and closer together at the first and second bent lips than at the fire stop connector whereby the fire resistant spring steel provides an inwardly directed spring action with respect to and between the first and second fire stop barriers and the outwardly bent lips act to outwardly spread apart the first and second fire stop barriers to receive and engage bored-in-lock assembly as bored-in-lock assembly is inserted through the latch opening.

14. The fire plate according to claim 13 wherein the fire plate snaps into engagement with the bored-in-lock assembly when the bored-in-lock assembly is inserted from the latch opening into the lock opening.

15. The fire plate according to claim 13 wherein the first fire stop barrier includes an elongated opening, the elongated opening engaging the bored-in-lock assembly and preventing rotation of the fire plate relative to the bored-in-lock assembly.

16. The fire plate according to claim 13 wherein the first fire stop barrier is upwardly offset relative to the second fire stop barrier, the first curved perimetrical edge of the first fire stop barrier contacting an upper part of the inner surface of the lock opening and the second curved perimetrical edge of the second fire stop barrier contacting a lower part of the inner surface of the lock opening.

17. A fire plate in combination with a bored-in-lock assembly, the fire plate preventing passage of fire through a lock opening bored from a first face of a door perpendicularly through the door to a second face of the door, the lock opening defining a lock opening axis and the bored-in-lock assembly being adapted for installation in a latch opening bored from an edge of the door into the lock opening perpendicular to the lock opening axis, the fire plate comprising:

a first fire stop barrier shaped to fit within the lock opening and having a first curved perimetrical edge corresponding in curvature to a curved inner surface of the lock opening, the first fire stop barrier extending across the lock opening to form a fire barrier oriented substantially parallel to the first face surface of the door and substantially perpendicular to the lock opening axis to resist passage of fire through the lock opening in the direction of the lock opening axis, the first fire stop barrier having a first opening for receiving a spindle from a first handle;

a second fire stop barrier having a second curved perimetrical edge corresponding in curvature to the curved inner surface of the lock opening, the second fire stop barrier having a second opening for receiving a spindle from a second handle; and a connecting barrier connecting the first and second fire stop barriers and holding the first and second fire stop barriers in an opposed relationship wherein prior to installation, the first and second fire stop barriers have a separation near the connector greater than the separation distal from the connector, and wherein after installation upon receiving the board-in-lock assembly extending through the latch opening and between the opposed first and second fire stop barriers, the first and second fire stop barriers create an inwardly directed spring action to grip the bored-in-lock assembly between them, with the separation distal from the connector being greater than prior to the installation of the bored-in-lock assembly.

18. The combination fire plate and bored in lock assembly according to claim 17 wherein the bored-in-lock assembly is manufactured, at least in part, of a material selected from the group consisting of plastic, brass, and aluminum, the group consisting of plastic, brass, and aluminum having a first melting point, and wherein the first fire stop barrier is formed from a material having a second melting point higher than the first melting point.

19. The combination fire plate and bored-in-lock assembly according to claim 17 wherein the fire resistant sheet material has spring properties providing an inwardly directed spring action with respect to and between the first and second fire stop barriers which grips the bored-in-lock assembly between the opposed first and second fire stop barriers.

20. The combination fire plate and bored-in-lock assembly according to claim 19 wherein the inwardly directed spring action causes the fire plate to snap into engagement with the bored-in-lock assembly when the bored in lock assembly is inserted between the first and second fire stop barriers.

21. The combination fire plate and bored in lock assembly according to claim 17 wherein the first and second fire stop barriers have corresponding opposed first and second outwardly bent lips, the first and second outwardly bent lips acting to spread apart the opposed first and second fire stop barriers and receive the bored-in-lock assembly between the opposed first and second fire stop barriers.

22. The combination fire plate and bored-in-lock assembly according to claim 21 wherein:

the first outwardly bent lip is at an opposite edge of the first fire stop barrier from the fire stop connector and the first curved perimetrical edge connects the first outwardly bent lip to the fire stop connector; and the second outwardly bent lip is at an opposite edge of the second fire stop barrier from the fire stop connector and the second curved perimetrical edge connects the second outwardly bent lip to the fire stop connector.

* * * * *